US007407087B2

(12) United States Patent
DeBusk et al.

(10) Patent No.: US 7,407,087 B2
(45) Date of Patent: Aug. 5, 2008

(54) RECLOSABLE CARTON

(75) Inventors: Patrick J. DeBusk, Larue, TX (US); Colin P. Ford, Woodstock, GA (US)

(73) Assignee: Graphic Packaging International, Inc., Marietta, GA (US)

( * ) Notice: Subject to any disclaimer, the term of this patent is extended or adjusted under 35 U.S.C. 154(b) by 701 days.

(21) Appl. No.: 10/935,918

(22) Filed: Sep. 8, 2004

(65) Prior Publication Data

US 2005/0247766 A1 Nov. 10, 2005

Related U.S. Application Data

(63) Continuation-in-part of application No. 10/841,927, filed on May 7, 2004, now Pat. No. 7,306,135.

(51) Int. Cl.
*B65D 5/54* (2006.01)

(52) U.S. Cl. ..... 229/101.1; 229/101.2

(58) Field of Classification Search ..... 229/101, 229/101.1, 101.2, 151, 152, 153, 235
See application file for complete search history.

(56) References Cited

U.S. PATENT DOCUMENTS

| | | | | |
|---|---|---|---|---|
| 417,076 | A * | 12/1889 | Osborn | 229/151 |
| 1,772,625 | A | 8/1930 | Caulfield | |
| 2,139,021 | A | 12/1938 | Johnson | |
| 2,396,310 | A | 3/1946 | Gibson | |
| 3,116,868 | A | 1/1964 | Lazure | |
| 3,167,240 | A | 1/1965 | Collura | |
| 3,266,705 | A * | 8/1966 | Wood | 229/152 |
| 3,302,855 | A | 2/1967 | Becker | |
| 3,327,923 | A | 6/1967 | Baughan | |
| 3,486,682 | A | 12/1969 | Mahon | |
| 3,690,544 | A | 9/1972 | Meyers | |
| 5,251,808 | A | 10/1993 | Rudd | |
| 6,119,929 | A | 9/2000 | Rose | |
| 6,336,584 | B1 | 1/2002 | Roch et al. | |
| 6,364,199 | B1 | 4/2002 | Rose | |
| 2005/0247766 | A1 | 11/2005 | Debusk et al. | |

FOREIGN PATENT DOCUMENTS

FR 1.183.269 9/1957

OTHER PUBLICATIONS

U.S. Appl. No. 10/841,927, filed May 7, 2004, DeBusk.

* cited by examiner

*Primary Examiner*—Gary E Elkins
(74) *Attorney, Agent, or Firm*—Womble Carlyle Sandridge & Rice, PLLC

(57) ABSTRACT

A carton that can be opened and incrementally reduced in size and reclosed is provided. A horizontal tear line is provided in a main panel of the carton and is connected to a tear line in each side panel that extends across to the other main panel. When these tear lines are torn, the carton is reduced in size by that increment. A reclosable top is formed in a main panel by two fold lines that extend across that panel. This carton may have several sections that can be incrementally reduced in size and reclosed as items are removed from the carton.

32 Claims, 5 Drawing Sheets

RECLOSABLE CARTON

This application is a continuation-in-part of our prior application Ser. No. 10/841,927, filed May 7, 2004, now U.S. Pat. No. 7,306,135, the disclosure of which is hereby incorporated by reference.

BACKGROUND OF THE INVENTION

1. Field of the Invention

The present invention relates generally to a carton for carrying a number of articles or containers which can be opened and some of the articles or containers removed and the carton reduced in size and reclosed. This process of removing articles or containers and reducing the carton in size and reclosing can be done two or three times or more if desired. The reduction in size is accomplished by providing a set of tear and fold lines for each reduction in size to allow part of the carton to be removed and discarded and to form a new reclosable top for the carton for the reduced size.

2. Background of the Invention

Cartons that carry a number of articles or containers are frequently opened one or more times and one or more articles or containers removed and the carton reclosed. This results in the carton having empty space on the inside which may present a problem if storage space is limited. This is particularly true of products like toasted pastries, spring rolls, and meat pies which are typically removed one or two at a time from a carton which is then reclosed and stored. A carton for carrying toasted pastries may be restored in a pantry, while a carton with meat pies may need to be restored in the refrigerator. It would be desirable to have a carton that could be reduced in size and reclosed after it has been opened and one or more articles or containers have been removed from the carton. It would be desirable to be able to reduce the carton in size incrementally two or three times and reclose the carton into a neat package similar to the package in which the product was initially purchased to eliminate the storage space the empty portion of the carton would occupy.

In our above referred to prior application Ser. No. 10/841,927, we describe a carton which can be incrementally reduced in size and reclosed. In the carton disclosed in that application, the tear lines in the side panels extend diagonally and gusset fold lines are provided in the side walls to facilitate reclosing of the top. While that carton works well for its intended purpose, the carton disclosed in the present application is of somewhat simpler construction and may be easier for the consumer to use.

SUMMARY OF THE INVENTION

Briefly described, the present invention relates to a carton that can be reopened and incrementally reduced in size and reclosed. This carton has two main panels, and foldably attached adjoining side panels. The carton has two ends with one end being an opening end that can be closed by two main end flaps. The other end of the carton may be closed in the same manner or with another type of closing means. This carton can be folded into a sleeve and glued together and loaded with articles or containers. The ends of the carton can then be closed and preferably glued together. The opening end of the carton can be opened and articles removed from the carton. The carton can then be incrementally reduced in size by pushing in and pulling a tab in the first closing flap in a main panel and removing the attached main end flap from the carton. Tear lines are provided in each side panel that extend from the open end of the carton near each side of the first closing flap to the fold line between each side panel and the opposite main panel. These side tear lines are connected to a first main tear line in the opposite main panel. The tearing of these side tear lines and first main tear line results in the removal of a portion of each side panel and the incremental opposite main panel. The other part of the first incremental section of the carton can then be folded into a reclosable top by folding the first closing flap and the first top panel about fold lines. This process can be continued for a second additional incremental reduction in the carton and reclosing the carton. The second increment results in alternating the various tear and fold lines so that the second top panel and second closing flap are located in the opposite main panel and the second main tear line is in the main panel. This process can be continued for a third additional incremental reduction in the carton and reclosing the carton. The third increment results in again alternating the various tear and fold lines so that the third top panel and third closing flap are located in the main panel and the third main tear line is in the opposite main panel. Following this method, additional incremental reductions may be made.

The tab that is used for removing the main end flap may have an arcuate tear line connecting it to the first closing flap. This tab may be used on each subsequent increment.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

DETAILED DESCRIPTION OF THE PREFERRED EMBODIMENT

The present invention is primarily for use with articles or containers which are removed from the carton one or two at a time and the carton reclosed. The carton of this invention is especially useful for products that are stored in the refrigerator or freezer and taken out of the carton which is restored with the remaining contents. Products such as toasted pastries, spring rolls and meat pies are typical of the products that are removed from a carton and the carton reclosed and restored either in the refrigerator or on a shelf. The carton of this invention can be opened and a product removed and the carton reduced in size and reclosed in increments. This incremental reduction in size of the carton and reclosing can be repeated two or three times or more.

Figure 1:
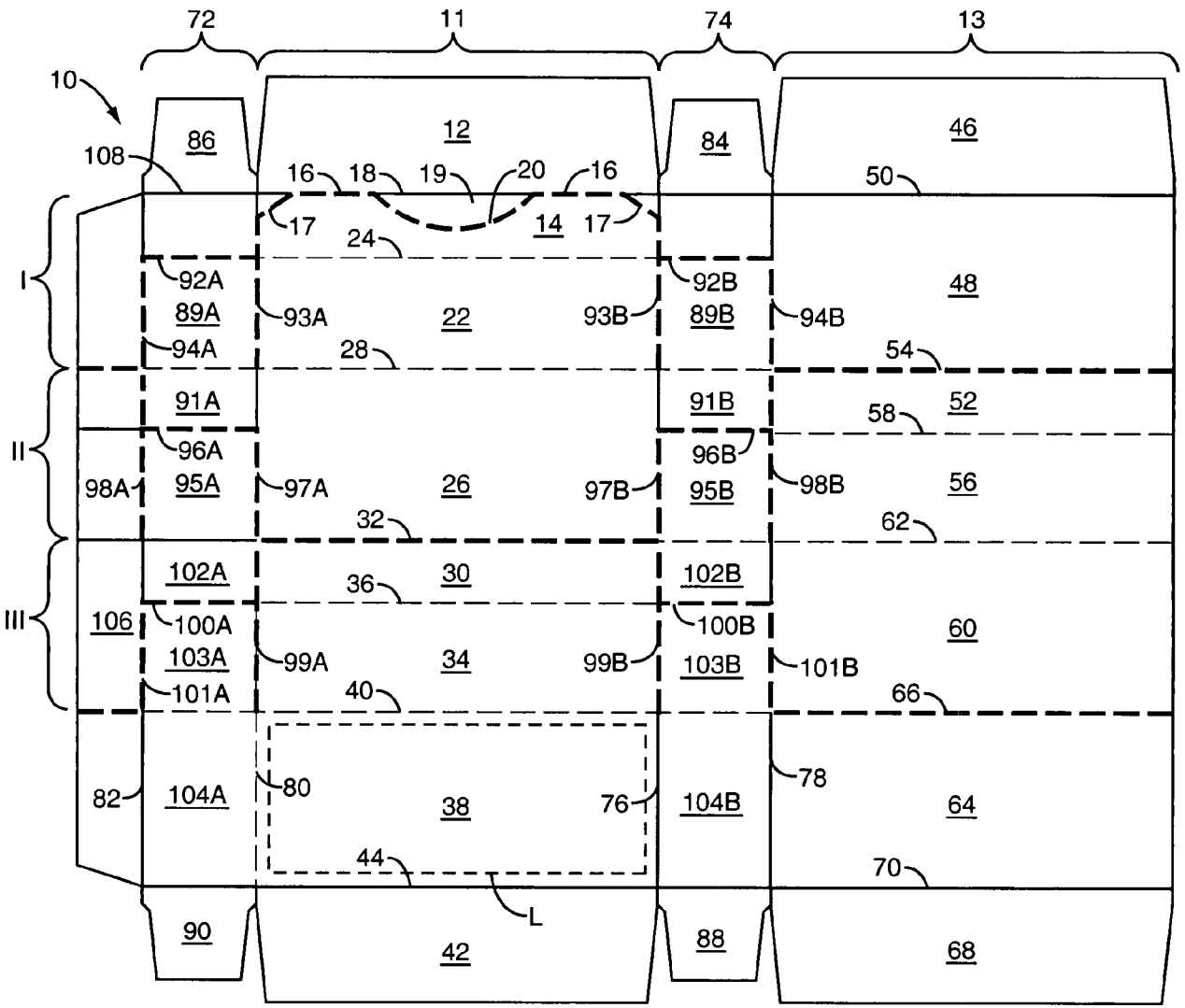
FIG. 1 is a plan view of the blank for forming one embodiment of a carton of this invention.

As illustrated in FIG. 1, the blank 10 for forming the carton of this invention is formed from a foldable sheet of material, such as paperboard. The carton of this invention has a main panel 11 and an opposite main panel 13. In viewing the main panel 11, a main end flap 12 is foldably attached to first closing flap 14 by fold line 18. A cut or tear line 16 is provided in lieu of a fold line along much of the border between the main end flap 12 and first closing flap 14, and tear lines 17 extend across corners of closing flap 14. A tab 19 may be formed along the fold line 18 by arcuate tear line 20 in first closing flap 14. First top panel 22 is foldably attached to first closing flap 14 by first end fold line 24. First incremental main panel 26 is foldably attached to first top panel 22 by first closing fold line 28.

First incremental main panel 26 is foldably attached to third closing flap 30 by second main tear line 32 and in turn attached to third top panel 34 by third end fold line 36. Third top panel 34 is foldably attached to third incremental main panel 38 by a third closing fold line 40. Third incremental main panel 38 is foldably attached to opposite main end flap 42 by fold line 44.

Opposite main panel 13 has main end flap 46 which is foldably attached to incremental opposite main panel 48 by fold line 50 and to second closing flap 52 by first main tear line 54. Second closing flap 52 is foldably attached to second top panel 56 by second end fold line 58 and to second incremental opposite main panel 60 by second closing fold line 62. Second incremental opposite main panel 60 is attached to third incremental opposite main panel 64 by third main tear line 66 and in turn attached to opposite main end flap 68 by fold line 70.

Side panel 72 is attached to main panel 11 by fold line 80 and in turn attached to glue flap 106 by fold line 82. Opposite side panel 74 is foldably attached to main panel 11 by fold line 76 and to opposite main panel 13 by fold line 78. Side panel 72 is foldably attached to side end flap 86 by fold line 108 and to opposite side end flap 90 by fold line 44. Opposite side panel 74 is foldably attached to side end flap 84 by fold line 50 and to opposite side end flap 88 by fold line 70.

The carton of this embodiment can be incrementally reduced in size three times and reclosed. The incremental sections that need to be torn and folded and reclosed are illustrated by Roman numerals I, II, and III in FIG. 1. In incremental section I, a portion 92A of a first side tear line extends across side panel 72 and a portion 92B of a first side tear line extends across opposite side panel 74. Portions 92A-B of the first side tear lines are both aligned with first end fold line 24. Portions 93A-B of the first side tear lines are located along fold lines 80, 76 and consist of tear lines which extend from tear lines 17 to first closing fold line 28. Portions 94A-B of the first side tear lines are located along fold lines 82, 78 and consist of tear lines which extend from first side tear line portions 92A-B to first main tear line 54.

In a similar fashion, incremental section II has second side tear lines 96A, 97A, 98A and 96B, 97B, 98B. Portion 96A extends across side panel 72 and portion 96B extends across opposite side panel 74. Portions 96A-B are aligned with second end fold line 58. Portions 97A-B are located along fold lines 80, 76 and consist of tear lines which extend from portions 96A-B to second main tear line 32. Portions 98A-B are located along fold lines 82, 78 and consist of tear lines which extend from first main tear line 54 to second closing fold line 62.

Incremental section III has third side tear lines 99A, 10A, 101A and 99B, 100B, 101B. Portions 100A-B extend across side panel 72 and opposite side panel 74 respectively, and both are aligned with third end fold line 36. Portions 99A-B are located along fold lines 80, 76 and consist of tear lines which extend from second main tear line 32 to third closing fold line 40. Portions 101A-B are located along fold lines 82, 78 and consist of tear lines which extend from portions 100A-B to third main tear line 66.

Figure 2:
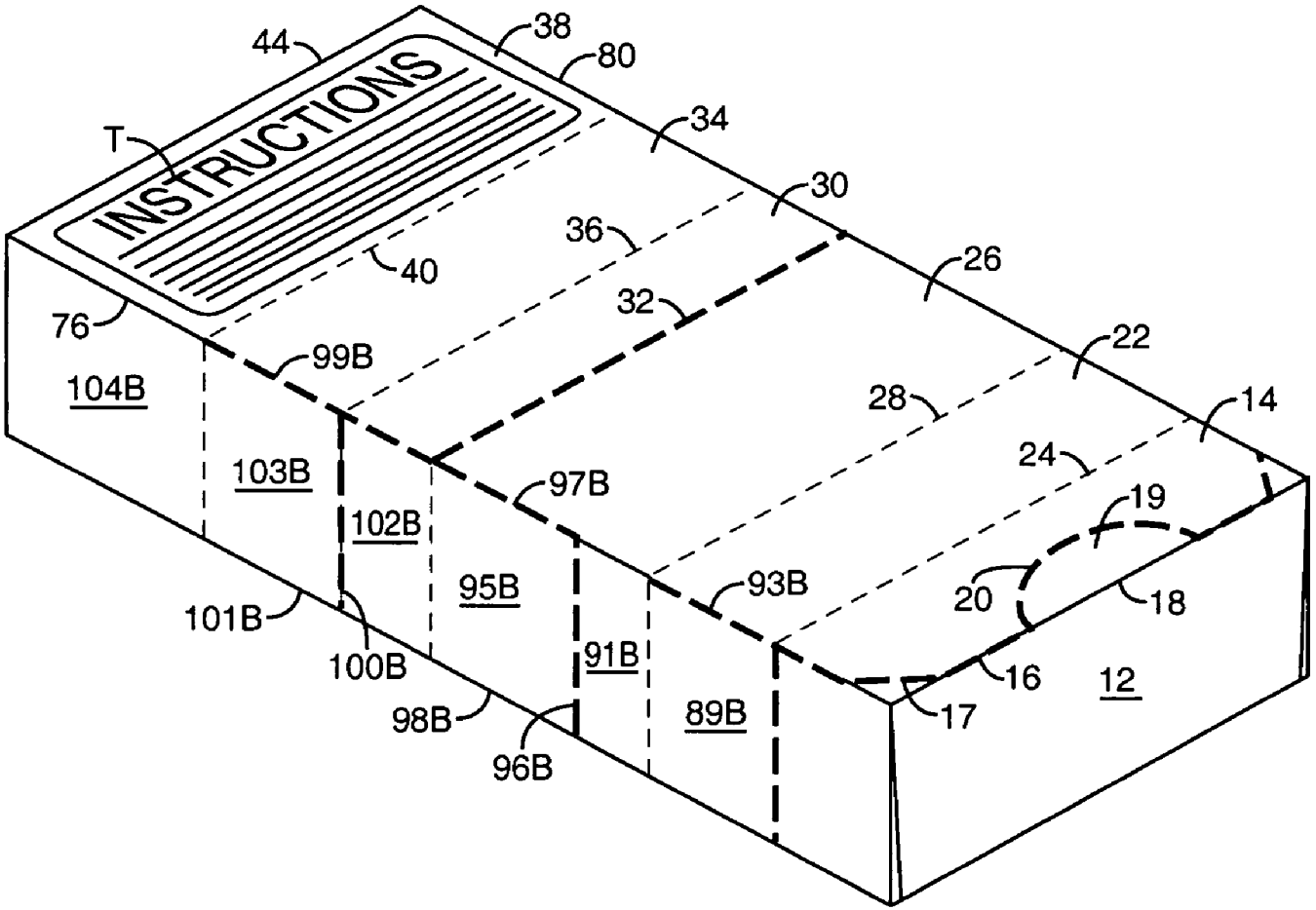
FIG. 2 is a perspective view of a carton formed from the blank of FIG. 1 which has been loaded with product, closed and sealed.

The blank 10 of FIG. 1 can be folded into a sleeve by folding fold lines 76, 78, 80 and 82 and gluing glue flap 106 to opposite main panel 13, thereby forming continuous tear lines 54, 66 and continuous fold lines 58, 62 across opposite main panel 13 and flap 106. This folded sleeve can be shipped to a packaging plant and opened and loaded with product, such as containers or articles. Side end flaps 84 and 86 can be closed and main end flaps 12 and 46 closed and glued. The opposite end of the carton can be closed by closing opposite side end flaps 88 and 90 and opposite main end flaps 42 and 68 and securing them by glue. The loaded and closed carton is shown in FIG. 2.

Figure 3:
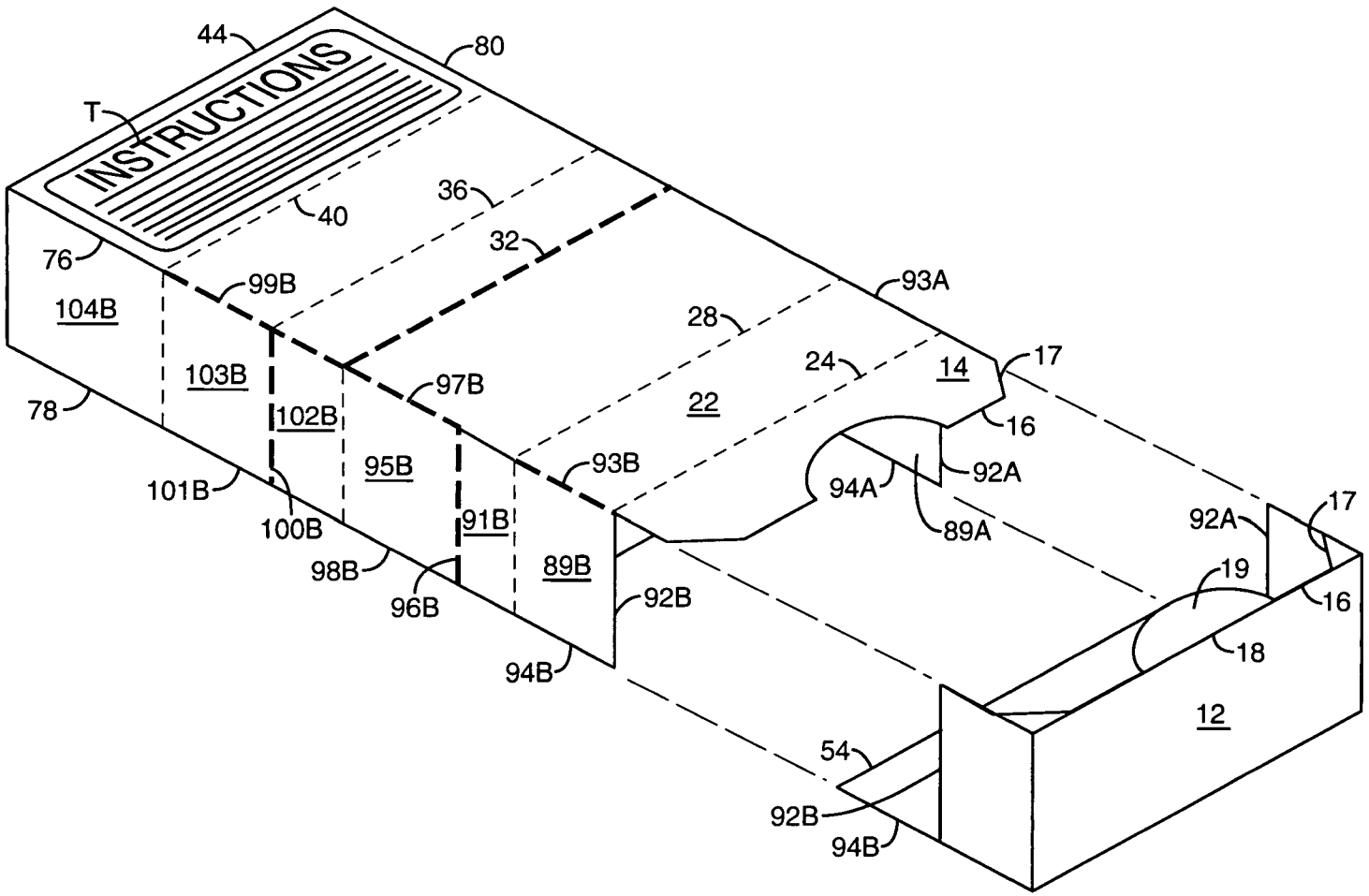
FIG. 3 is a perspective view of the loaded carton of FIG. 2 which has been opened and some articles or containers removed from the carton and the first removable incremental section near the opening end of the carton torn away from the carton.

The opening end of this carton can be opened in the conventional manner by tearing main end flap 12 from the main end flap 46. This will allow all or part of the contents of the carton to be removed. This carton can be reclosed in the conventional manner by reclosing side end flaps 84 and 86 and main end flaps 12 and 46, or, if desired, this carton can be reduced in size by the tearing and folding of incremental section I. This accomplished by pushing in tab 19 resulting in the tearing of arcuate tear line 20 which results in the tearing of main end flap 12 from the carton. The tearing is then continued along tear lines 16 and 17, down first side tear line portions 93A-B, down portions 92A-B, along portions 94A-B, and across first main tear line 54 in opposite main panel 13. This first main tear line 54 will define the top of the carton when the tearing and folding of incremental section I is completed. This allows the removal of the removable sections of incremental section I as illustrated in FIG. 3. Although tear lines 17 across the corners of first closing flap 14 aid in tearing the first side tear line portions 92A-B, they can be eliminated if desired, and tear lines 16 extended to intersect with tear line portions 93A-B.

Figure 4:
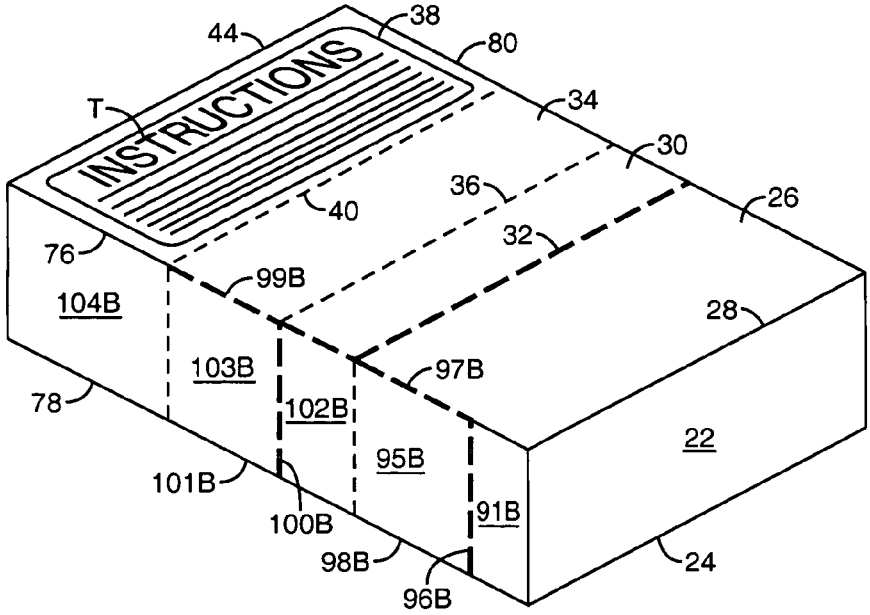
FIG. 4 is a perspective view of the carton of FIG. 3 in which the first reclosable top has been folded and closed.

As shown in FIG. 1, tearing along first side tear lines 92A-B, 93A-B and 94A-B forms flaps 89A-B at the sides of the carton. The completion of the tearing in respect to incremental section I is illustrated in FIG. 3 where the removable section of incremental section I has been removed from the carton. Now that the carton has been reduced in size, it can be easily reclosed by folding flaps 89A-B inward, folding in the first closeable flap 14 along first end line 24 and closing the first top panel 22 along fold line 28, over flaps 89A-B. The first reclosable top is secured by first closing flap 14 being placed inside the carton adjacent to the inside of second closing flap 52. This reclosed carton is illustrated in FIG. 4. As is evident from FIG. 4, the distance between first end fold line 24 and first closing fold line 28 is approximately the same as the width of side panels 72 and 74, i.e., is approximately the same as the distance between the main panel 11 and opposite main panel 13.

This carton can be easily reopened and additional contents removed. The carton can then be reduced in size and reclosed by removing the removal sections of incremental section II in the same fashion that was done with incremental section I.

Figure 5:
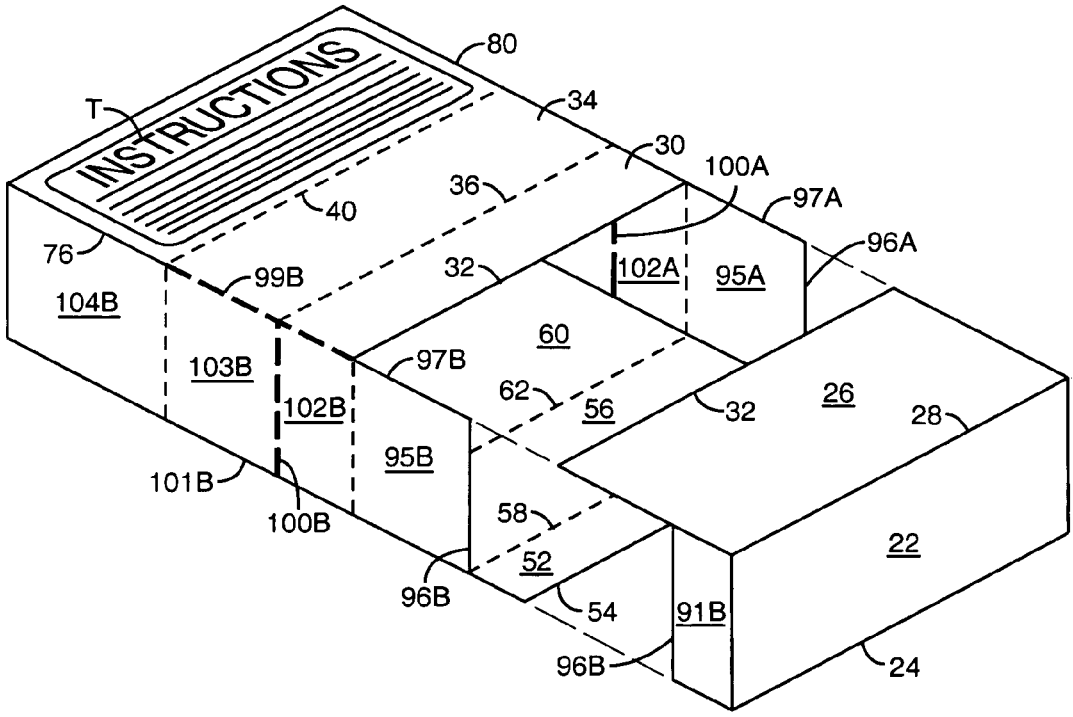
FIG. 5 is a perspective view of the carton of FIG. 4 which has been reopened and product removed and the second removable incremental section torn away from the opening end of the carton.
Figure 6:
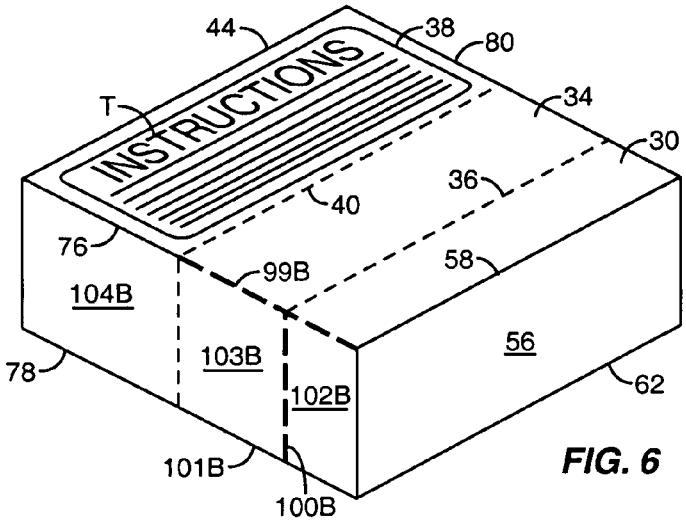
FIG. 6 is a perspective view of the carton of FIG. 5 in which the second reclosable top has been folded and closed.

The removable sections of incremental section II are torn along second side tear lines 96A-B, 97A-B and 98A-B, and across second main tear line 32. This forms flaps 95A-B at the sides of the carton and results in the removal of first incremental main panel 26, flaps 89A-B, and the second removable sections 91A-B from side panels 72 and 74 as illustrated in FIG. 5. The second reclosable top for incremental section II can be closed by folding flaps 95A-B inward, folding second closing flap 52 along second end fold line 58 and second top panel 56 along second closing fold line 62. Second closing flap 52 is inserted on the side of main panel 11 adjacent to third closing flap 30. The reclosed carton is illustrated in FIG. 6. As shown in FIG. 6, the distance between the second end fold line 58 and the second closing fold line 62 is approximately the same as the width of side panels 72 and 74, i.e., is approximately the same as the distance between the main panel 11 and opposite main panel 13.

Figure 7:
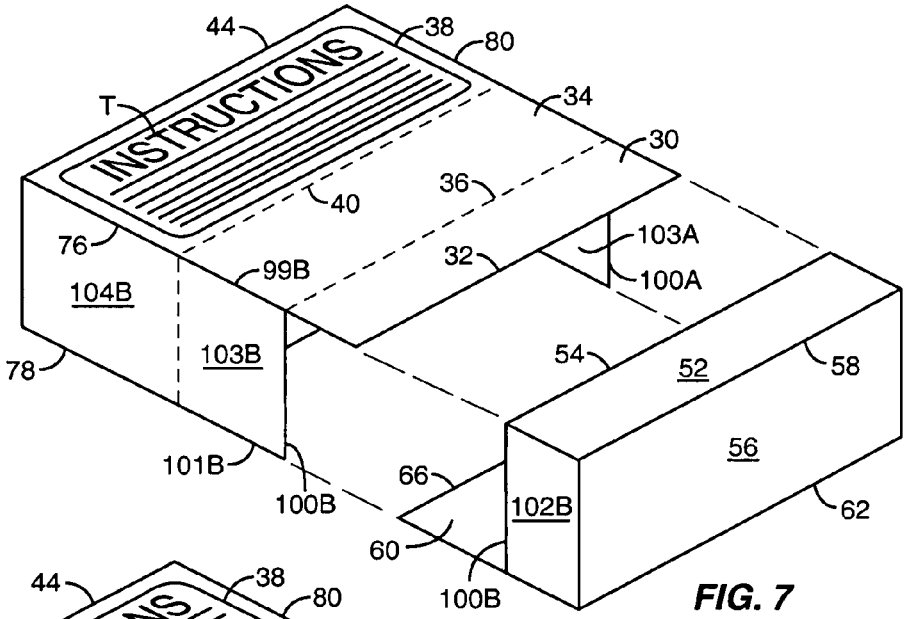
FIG. 7 is a perspective view of the carton of FIG. 6 which has been reopened and product removed and the third removable incremental section torn away from the opening end of the carton.
Figure 8:
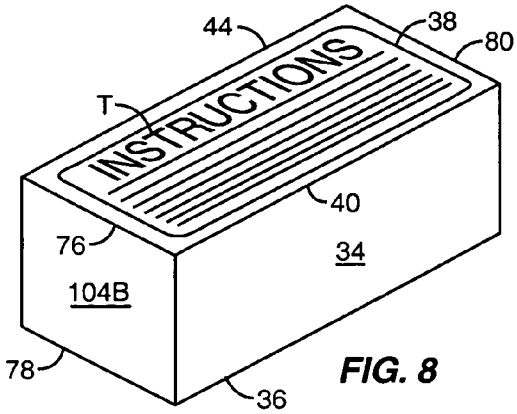
FIG. 8 is a perspective view of the carton of FIG. 7 in which the third reclosable top has been folded and reclosed.

This carton can be opened a third time by removing the removable section and folding sections of incremental section III. Third side tear lines 99A-B, 100A-B and 101A-B are torn and third main tear line 66 is torn. This forms flaps 103A-B at the sides of the carton and results in the removal of second incremental opposite main panel 60 and the third removable sections 102A-B of side panels 72 and 74. The removal of the removable section of incremental section III is illustrated in FIG. 7. The third reclosable top can be closed by folding flaps 103A-B inward, folding third closing flap 30 along third end fold line 36, folding third top panel 34 along third closing fold line 40, and inserting third closing flap 30 inside of opposite main panel 13 adjacent to third incremental opposite main panel 64. This reclosed carton is illustrated in FIG. 8. As shown in FIG. 8, the distance between the third end fold line 36 and the third closing fold line 40 is approximately the same as the width of side panels 72 and 74, i.e., is approximately the same as the distance between the main panel 11 and opposite main panel 13.

If desired a tab similar to tab 19 can be placed adjacent to first main tear line 54 in second closing flap 52 and along second main tear line 32 in third closing flap 30 to facilitate tearing along the second side tear lines and third side tear lines.

While three incremental sections I, II and III are shown in this embodiment, a fewer or larger number of incremental sections can be placed in a carton. It should also be realized that the incremental sections do not all have to be of the same size.

The reclosable carton of this invention is suitable for packaging articles or containers that are placed in a carton and removed one or more at a time. The carton of this invention is especially useful for products that are stored in the refrigerator, freezer, or pantry where space is limited. This reclosable carton also helps to preserve the freshness of items contained in the carton.

If a recipe or instructions are to be included with a product that is contained in this carton, such as a food product that is to baked or heated, the recipe or instructions T can be repeated on each increment of the carton. For example, a main label with a recipe or heating instructions could be repeated for the entire carton on each incremental segment. The main label could be placed on incremental opposite main panel 48, first incremental main panel 26, second incremental opposite main panel 60 and third incremental main panel 38. This is possible with this embodiment because it is designed to have a large main panel each time a removable section is removed from the carton. It is preferable for appearance purposes to have the instructions or recipe printed only once, which should be on the third incremental main panel 38 which will be present on each incremental carton since incremental section III is the mother pack. The letter L as shown in FIG. 1 represents the border of the instructions or recipe T as viewed from the inside of the blank.

One characteristic of this embodiment of the invention is that the side tear lines in each incremental section are parallel to each other when the blank has been formed into a carton. For example, first side tear lines 92A, 93A, 94A and 92B, 93B, 94B are parallel to each other. This facilitates tearing off the removable sections of each incremental section and producing a well defined reclosable top. In order to have the top of the carton in the same plane each time it is reclosed the closing fold line should be interconnected with the main tear line. For example, first closing fold line 28 should be interconnected with first main tear line 54. It should also be appreciated that the closing fold lines 28, 62, and 40 basically serve as hinges for closing top panels 22, 56, and 34 respectively when the reclosable top is being closed and opened.

Other systems, methods, features, and advantages of the present invention will be or become apparent to one with skill in the art upon examination of the following drawings and detailed description. It is intended that all such additional systems, methods, features, and advantages be included within this description, be within the scope of the present invention, and be protected by the accompanying claims.

Therefore, having thus described the invention, at least the following is claimed:

1. A carton for carrying a plurality of articles, that can be opened and incrementally reduced in size and reclosed, comprising:

(a) a main panel, an opposite main panel and foldably attached adjoining side panels, said carton having two ends, with one end being an opening end that is closed by two main end flaps, with the other end of the carton being closed by closing means; and (b) said carton having a first closing fold line with two ends, said fold line being at least substantially parallel to and at a distance from the opening end of the carton, said first closing fold line extending across the main panel and both side panels, with each end of said first closing fold line interconnecting with a first main tear line that extends across the opposite main panel, said main panel having a first end fold line that is at least substantially parallel to the opening end of the carton, and which is spaced from the first closing fold line towards the opening end of the carton at a distance that is approximately the same as the distance between the main and opposite main panels, with each side panel having a first side tear line that extends from the intersection of the first closing fold line with the opposite main panel to the main panel near the opening end of the carton, said first side tear lines in the side panels interconnecting with the first main tear line in the opposite main panel, the arrangement of said first tear lines permitting the removal of sections of the carton when said first tear lines are torn open, the arrangement of the first side tear lines permitting the removal of sections of each said side panel while leaving closing flaps in each said side panel when the first side tear lines are torn open, the arrangement of said first closing fold line and first end fold line permitting the opening end of the carton to be reclosed when said fold lines are folded to create a reclosable top.

2. The carton of claim 1, in which the means for closing the other end of the carton are two main end flaps.

3. The carton of claim 1, in which each said first side tear line comprises a plurality of interconnected tear lines.

4. The carton of claim 3, in which each plurality of interconnected tear lines includes a tear line which is aligned with the first end fold line.

5. The carton of claim 3, in which each plurality of interconnected tear lines defines a flap foldably attached to a side panel of the side panels.

6. The carton of claim 1, in which the first side tear lines in both side panels are at least substantially parallel to each other.

7. The carton of claim 1, in which a main end flap is foldably attached to the main panel by a tear line in the main panel which has a arcuate section extending towards the first end fold line which forms a tab in the main panel to aid in the removal of the main end flap attached to the main panel.

8. The carton of claim 1, in which at least a portion of each first side tear line is aligned with the first end fold line.

9. A carton for carrying a plurality of articles, that can be opened and incrementally reduced in size and reclosed, comprising:

a main panel, an opposite main panel and foldably attached adjoining side panels, said carton having two ends, with one end being an opening end that is closed by two main end flaps, with the other end of the carton being closed by closing means;

said carton having a first closing fold line with two ends, said fold line being at least substantially parallel to and at a distance from the opening end of the carton, said first closing fold line extending across the main panel and both side panels, with each end of said first closing fold line interconnecting with a first main tear line that extends across the opposite main panel, said main panel having a first end fold line that is at least substantially parallel to the opening end of the carton, and which is spaced from the first closing fold line towards the opening end of the carton at a distance that is approximately the same as the distance between the main and opposite main panels, with each side panel having a first side tear line that extends from the intersection of the first closing fold line with the opposite main panel to the main panel near the opening end of the carton, said first side tear lines in the side panels interconnecting with the first main tear line in the opposite main panel, the arrangement of said first tear lines permitting the removal of sections of the carton when said first tear lines are torn open, the arrangement of said first closing fold line and first end fold line permitting the opening end of the carton to be reclosed when said fold lines are folded to create a reclosable top; and a second closing fold line with two ends, said second closing fold line being at least substantially parallel to and at a distance greater from the opening end of the carton than the first closing fold line, said second closing fold line extending across the opposite main panel and both side panels, with each end of said second closing fold line interconnecting with a second main tear line that extends across the main panel, said opposite main panel having a second end fold line that is at least substantially parallel to the opening end of the carton and which is spaced from the second closing fold line towards the opening end of the carton at a distance that is approximately the same as the distance between the main and opposite main panels, with each side panel having a second side tear line that extends from the intersection of the second closing fold line with the main panel to the opposite main panel and interconnecting with said first main tear line in the opposite main panel, the arrangement of said second tear lines permitting the removal of sections of the carton when said second tear lines are torn open after the removal of sections of the carton by tearing the first tear lines, the arrangement of said second closing fold line and second end fold line permitting the opening end of the carton to be reclosed when said fold lines are folded to create a reclosable top.

10. The carton of claim 9, in which each said second side tear line comprises a plurality of interconnected tear lines.

11. The carton of claim 10, in which each plurality of interconnected tear lines includes a tear line which is aligned with the second end fold line.

12. The carton of claim 10, in which each plurality of interconnected tear lines defines a flap foldably attached to a side panel of the side panels.

13. The carton of claim 9, in which at least a portion of each second side tear line is aligned with the second end fold line.

14. The carton of claim 9, which can be further incrementally reduced in size and reclosed, comprising a third closing fold line with two ends, said third closing fold line being at least substantially parallel to and at a distance greater from the opening end of the carton than the second closing fold line, said third closing fold line extending across the main panel and both side panels, with each end of said third closing fold line interconnecting with a third main tear line that extends across the opposite main panel, said main panel having a third end fold line that is at least substantially parallel to the opening end of the carton and which is spaced from the third closing fold line towards the opening end of the carton at a distance that is approximately the same as the distance between the main and opposite main panels, with each side panel having a third side tear line that extends from the intersection of the third closing fold line with the opposite main panel to the main panel and interconnecting with said second main tear line in the main panel, the arrangement of said third tear lines permitting the removal of sections of the carton when said third tear lines are torn open after the removal of sections of the carton by tearing the second tear lines, the arrangement of said third closing fold line and third end fold line permitting the opening end of the carton to be reclosed when said fold lines are folded to create a reclosable top.

15. The carton of claim 14, in which each said third side tear line comprises a plurality of interconnected tear lines.

16. The carton of claim 15, in which each plurality of interconnected tear lines includes a tear line aligned with the third end fold line.

17. The carton of claim 15, in which each plurality of interconnected tear lines defines a flap foldably attached to a side panel of the side panels.

18. The carton of claim 14, in which at least a portion of each third side tear line is aligned with the third end fold line.

19. A carton for carrying a plurality of articles, that can be opened and incrementally reduced in size and reclosed, comprising:

(a) a main panel, an opposite main panel and foldably attached adjoining side panels, said carton having two ends, with one end being an opening end that is closed by two main end flaps, with the other end of the carton being closed by closing means; and (b) said carton having a first closing fold line with two ends, said fold line being at least substantially parallel to and at a distance from the opening end of the carton, said first closing fold line extending across the main panel and both side panels, with each end of said first closing fold line interconnecting with a first main tear line that extends across the opposite main panel, said main panel having a first end fold line that is at least substantially parallel to the opening end of the carton, and which is spaced from the first closing fold line towards the opening end of the carton at a distance that is approximately the same as the distance between the main and opposite main panels, with each side panel having a first side tear line that extends from the intersection of the first closing fold line with the opposite main panel to the main panel near the opening end of the carton, said first side tear lines in the side panels interconnecting with the first main tear line in the opposite main panel, the arrangement of said first tear lines permitting the removal of sections of the carton when said first tear lines are torn open, the arrangement of said first closing fold line and first end fold line permitting the opening end of the carton to be reclosed when said fold lines are folded to create a reclosable top;

(c) said carton can be further incrementally reduced in size and reclosed by a second closing fold line with two ends, said second closing fold line being at least substantially parallel to and at a distance greater from the opening end of the carton than the first closing fold line, said second closing fold line extending across the opposite main panel and both side panels, with each end of said second closing fold line interconnecting with a second main tear line that extends across the main panel, said opposite main panel having a second end fold line that is at least substantially parallel to the opening end of the carton and which is spaced from the second closing fold line towards the opening end of the carton at a distance that is approximately the same as the distance between the main and opposite main panels, with each side panel having a second side tear line that extends from the intersection of the second closing fold line with the main panel to the opposite main panel and interconnecting with said first main tear line in the opposite main panel, the arrangement of said second tear lines permitting the removal of sections of the carton when said second tear lines are torn open after the removal of sections of the carton by tearing the first tear lines, the arrangement of said second closing fold line and second end fold line permitting the opening end of the carton to be reclosed when said fold lines are folded to create a reclosable top; and (d) said carton can be further incrementally reduced in size and reclosed by a third closing fold line with two ends, said third closing fold line being at least substantially parallel to and at a distance greater from the opening end of the carton than the second closing fold line, said third closing fold line extending across the main panel and both side panels, with each end of said third closing fold line interconnecting with a third main tear line that extends across the opposite main panel, said main panel having a third end fold line that is at least substantially parallel to the opening end of the carton and which is spaced from the third closing fold line towards the opening end of the carton at a distance that is approximately the same as the distance between the main and opposite main panels, with each side panel having a third side tear line that extends from the intersection of the third closing fold line with the opposite main panel to the main panel and interconnecting with said second main tear line in the main panel, the arrangement of said third tear lines permitting the removal of sections of the carton when said third tear lines are torn open after the removal of sections of the carton by tearing the second tear lines, the arrangement of said third closing fold line and third end fold line permitting the opening end of the carton to be reclosed when said fold lines are folded to create a reclosable top.

20. The carton of claim 19, in which the means for closing the other end of the carton are two main end flaps.

21. The carton of claim 19, in which each side tear line comprises a plurality of interconnected tear lines.

22. The carton of claim 21, in which each plurality of interconnected tear lines includes a tear line aligned with the end of the corresponding end fold line.

23. The carton of claim 19, in which each side panel has end flaps on each end of the carton to completely close the ends of the carton.

24. The carton of claim 19, in which a main end flap is foldably attached to the main panel by a tear line in the main panel which has an arcuate section extending towards the first end fold line which forms a tab in the main panel to aid in the removal of the main end flap attached to the main panel.

25. A carton for carrying a plurality of articles, that can be opened and incrementally reduced in size and reclosed a plurality of times, comprising:

a. two main panels and foldably attached adjoining side panels, said carton having two ends, with one end being an opening end that is closed by two main end flaps, with the other end of the carton being closed by closing means; and b. said carton having a plurality of closing fold lines, each with two ends and being at least substantially parallel to the opening end of the carton and extending across one main panel of the two main panels and both side panels with the closing fold lines placed at different distances from the opening end to establish the hinge for an incremental reclosable top, with each end of each closing fold line interconnecting with a main tear line that extends across the other main panel to define an incremental top opening for the carton, with each closing fold line having an end fold line that is at least substantially parallel to said closing fold line and spaced towards the opening end of the carton from the closing fold line at a distance that is approximately the same as the distance between the main panels, each said end fold line constituting the hinge between the top panel and the closing flap of the incremental reclosable top to secure the reclosing of the reclosable top, said carton having a plurality of side tear lines in each side panel, with each side tear line extending towards the open end of the carton from the intersection in the side panel of the closing fold line and main tear line, with each side tear line extending to the main panel near to the opening end of the carton in which said closing fold line is located, said side tear lines interconnecting with the corresponding main tear line, the arrangement of said tear lines permitting the removal of sections of the carton in increments when said tear lines are torn open, the arrangement of the first side tear lines permitting the removal of sections of each said side panel while leaving closing flaps in each said side panel when the first side tear lines are torn open, with the arrangement of a closing fold line and corresponding end fold line permitting the opening end of the carton to be closed when said fold lines are folded to create an incremental reclosable top.

26. The carton of claim 25, in which the means for closing the other end of the carton are two main end flaps.

27. The carton of claim 25, in which each side tear line comprises a plurality of interconnected tear lines.

28. The carton of claim 27, in which each plurality of interconnected tear lines includes a tear line aligned with the end fold line associated with the closing fold line from which the side tear line extends.

29. The carton of claim 27, in which each plurality of interconnected tear lines defines a flap foldably connected to a side panel of the side panels.

30. The carton of claim 25, in which each end fold line in a main panel of the two main panels extends to a tear line of the side tear lines in each side panel.

31. The carton of claim 25, in which a main end flap is foldably attached to the one main panel by a tear line in the one main panel which has an arcuate section extending towards the end fold line which forms a tab in the one main panel to aid in the removal of the main end flap attached to the one main panel.

32. The carton of claim 25, which has a main label printed on a panel of each incrementally reduced section of the carton.

* * * * *